US011421621B2

(12) United States Patent
Simoson et al.

(10) Patent No.: US 11,421,621 B2
(45) Date of Patent: Aug. 23, 2022

(54) SYSTEM AND METHOD FOR ENGINE OPERATION

(71) Applicant: Powerhouse Engine Solutions Switzerland IP Holding GmbH, Zug (CH)

(72) Inventors: Christopher Simoson, North East, PA (US); Jennifer Lachapelle, Fort Worth, TX (US); Preeti Vaidya, Bangalore (IN)

(73) Assignee: Powerhouse Engine Solutions Switzerland IP Holding GmbH, Zug (CH)

( * ) Notice: Subject to any disclaimer, the term of this patent is extended or adjusted under 35 U.S.C. 154(b) by 0 days.

(21) Appl. No.: 17/374,556

(22) Filed: Jul. 13, 2021

(65) Prior Publication Data

US 2022/0018302 A1 Jan. 20, 2022

(30) Foreign Application Priority Data

Jul. 16, 2020 (IN) ..... 202041030365

(51) Int. Cl.
*F02D 41/30* (2006.01)
*F02D 41/24* (2006.01)
(Continued)

(52) U.S. Cl.
CPC ..... *F02D 41/2422* (2013.01); *F02D 13/0215* (2013.01); *F02D 41/0002* (2013.01);
(Continued)

(58) Field of Classification Search
CPC ..... F02D 41/2422; F02D 41/0002; F02D 41/0082; F02D 41/3836; F02D 13/0215;
(Continued)

(56) References Cited

U.S. PATENT DOCUMENTS 7,127,345 B2 * 10/2006 Chen ..... F02D 41/0097 701/105
2006/0178800 A1 8/2006 Chen et al.
2011/0056199 A1 3/2011 Gokhale et al.

FOREIGN PATENT DOCUMENTS

DE 102017108367 A1 11/2017
JP H10266881 A 10/1998
(Continued)

OTHER PUBLICATIONS

"The best bank accounts for switching bonuses," Love Money Website, Available Online at https://www.lovemoney.com/bestbuy/50660/the-best-bank-accounts-for-switching-bonuses, Available as Early as Sep. 22, 2016, 5 pages.
(Continued)

*Primary Examiner* — Hai H Huynh
(74) *Attorney, Agent, or Firm* — McCoy Russell LLP

(57) ABSTRACT

Systems and methods for operating an engine and controlling engine parameters over a range of ambient temperature conditions are provided. A method for an engine includes selecting one or more of an engine speed, an engine load, a base timing, and a fuel common rail pressure from a pre-calibrated engine map corresponding to a selected throttle level and modifying the one or more of the engine speed, the engine load, the base timing, and the fuel common rail pressure based on sensed environmental conditions.

20 Claims, 11 Drawing Sheets

(51) Int. Cl.

| | |
|---|---|
| ***F02D 13/02*** | (2006.01) |
| ***F02D 41/00*** | (2006.01) |
| ***F02D 41/38*** | (2006.01) |
| *B61C 5/00* | (2006.01) |

(52) U.S. Cl.
CPC ..... *F02D 41/0082* (2013.01); *F02D 41/3836* (2013.01); *B61C 5/00* (2013.01); *F02D 2041/001* (2013.01); *F02D 2200/0404* (2013.01); *F02D 2200/0406* (2013.01); *F02D 2200/0602* (2013.01); *F02D 2200/101* (2013.01); *F02D 2200/70* (2013.01)

(58) Field of Classification Search
CPC ..... F02D 2041/001; F02D 2200/0404; F02D 2200/0406; F02D 2200/00602; F02D 2200/101; F02D 2200/70; B61C 5/00
USPC ..... 123/399, 436, 339.1; 701/103–105, 110
See application file for complete search history.

(56) References Cited

FOREIGN PATENT DOCUMENTS

| | | | |
|---|---|---|---|
| RU | 2583481 | C2 | 5/2016 |
| RU | 2646039 | C2 | 2/2018 |
| RU | 2665800 | C2 | 9/2018 |
| SU | 1617170 | A1 | 12/1990 |

OTHER PUBLICATIONS

European Patent Office, Extended European Search Report Issued in Application No. 21168986.4, dated Oct. 11, 2021, Germany, 9 pages.
Federal Institute of Industrial Property, Search Report Issued in Application No. 202092384, dated Feb. 18, 2022, 5 pages.

* cited by examiner

500

| Throttle Level 502 | Speed (in RPM) 504 | Load (in HP) 506 | Base Timing (in dB TDC) 508 | RP (in bar) 510 |
|---|---|---|---|---|
| N8 | 1800 | 1475 | 22.4 | 1525 |
| N7 | 1650 | 1214 | 22.1 | 1450 |
| N6 | 1650 | 972 | 21.4 | 1450 |
| N5 | 1500 | 738 | 17.8 | 1400 |
| N4 | 1350 | 516 | 11.1 | 1300 |
| N3 | 1200 | 302 | 17 | 1100 |
| N2 | 1000 | 145 | 13.9 | 1000 |
| N1 | 700 | 80 | 9.6 | 800 |
| Idle | 500 | 11 | 5 | 600 |

FIG. 5

600

| Base Tmg | Engine Speed | | | | | | | | | | |
|---|---|---|---|---|---|---|---|---|---|---|---|
| E Power | 225 | 500 | 700 | 840 | 1000 | 1200 | 1350 | 1500 | 1650 | 1800 | 1980 |
| 0 | 5 | 5 | 8 | 10 | 13 | 15 | 17 | 22 | 23 | 24 | 24 |
| 50 | 5 | 5 | 9.6 | 11 | 13 | 15 | 17 | 22 | 23 | 24 | 24 |
| 100 | 9 | 9 | 9.6 | 12 | 13.9 | 15 | 19 | 22 | 23 | 24 | 24 |
| 150 | 9 | 9 | 9.6 | 12 | 13.9 | 15 | 21 | 22 | 23 | 24 | 24 |
| 190 | 9 | 9 | 10 | 13 | 13.9 | 15 | 18 | 22 | 24 | 24 | 24 |
| 225 | 9 | 9 | 12 | 14 | 15 | 17 | 13 | 20 | 24 | 24 | 24 |
| 385 | 9 | 9 | 13 | 15 | 16 | 17 | 11.1 | 17.8 | 23 | 24 | 24 |
| 550 | 9 | 9 | 13 | 15 | 16 | 17 | 13 | 17.8 | 21.5 | 23 | 23 |
| 725 | 9 | 9 | 13 | 15 | 16 | 17 | 17 | 17.8 | 21.4 | 22 | 22 |
| 900 | 9 | 9 | 13 | 15 | 16 | 17 | 17 | 17.8 | 22.1 | 22.2 | 22.2 |
| 1100 | 9 | 9 | 13 | 15 | 16 | 17 | 17 | 17.8 | 22.2 | 22.4 | 22.4 |

FIG. 6A

650

| Rail P | Engine Speed | | | | | | | | | | |
|---|---|---|---|---|---|---|---|---|---|---|---|
| E Power | 225 | 500 | 700 | 840 | 1000 | 1200 | 1350 | 1500 | 1650 | 1800 | 1980 |
| 0 | 600 | 600 | 700 | 800 | 900 | 1000 | 1000 | 1000 | 1000 | 1000 | 1000 |
| 50 | 600 | 600 | 800 | 900 | 900 | 1000 | 1000 | 1000 | 1000 | 1000 | 1000 |
| 100 | 600 | 600 | 800 | 900 | 1000 | 1000 | 1000 | 1000 | 1100 | 1100 | 1100 |
| 150 | 600 | 600 | 800 | 900 | 1000 | 1000 | 1100 | 1100 | 1100 | 1200 | 1200 |
| 190 | 600 | 600 | 900 | 1000 | 1000 | 1100 | 1100 | 1150 | 1150 | 1200 | 1200 |
| 225 | 600 | 600 | 900 | 1100 | 1100 | 1100 | 1150 | 1150 | 1175 | 1250 | 1250 |
| 385 | 600 | 600 | 1000 | 1100 | 1200 | 1200 | 1300 | 1300 | 1300 | 1300 | 1300 |
| 550 | 600 | 600 | 1000 | 1100 | 1200 | 1300 | 1300 | 1400 | 1400.0 | 1400 | 1400 |
| 725 | 600 | 600 | 1000 | 1100 | 1200 | 1300 | 1400 | 1400 | 1450 | 1450 | 1450 |
| 900 | 600 | 600 | 1000 | 1100 | 1200 | 1300 | 1400 | 1400 | 1450 | 1500 | 1500 |
| 1100 | 600 | 600 | 1000 | 1100 | 1200 | 1300 | 1400 | 1400 | 1500 | 1525 | 1525 |

FIG. 6B

SYSTEM AND METHOD FOR ENGINE OPERATION

CROSS REFERENCE TO RELATED APPLICATIONS

The present application claims priority to Indian Patent Application No. 202041030365, entitled "SYSTEM AND METHOD FOR ENGINE OPERATION," and filed on Jul. 16, 2020. The entire contents of the above-listed application are hereby incorporated by reference for all purposes.

BACKGROUND

Technical Field

Embodiments of the subject matter disclosed herein relate to determination of engine parameters over a range of ambient temperature conditions.

Discussion of Art

Some vehicles include power sources, such as diesel internal combustion engines. Internal combustion engine systems used in certain geographical locations may be subjected to a wide variation in ambient temperatures (e.g., across diurnal cycles). In an engine, power output and engine speed may be adjusted by an operator by selecting a throttle level. Engine operating parameters may be determined by an engine controller based on the selected throttle level. For example, selection of a higher throttle level may correspond to a larger opening of an air intake and a larger fuel delivery to the engine. Due to diurnal variations in ambient conditions, performance of the engine at any given throttle level selected may be affected. It may be desirable to have a system and method that differ from those that are currently available.

BRIEF DESCRIPTION

In one embodiment, a method for operating an engine may include obtaining one or more ambient environmental conditions, obtaining a desired throttle level for the engine, obtaining one or more determined engine operating parameters based at least in part on the desired throttle level and an engine operating map, and changing the one or more determined engine operating parameters obtained from the engine operating map based at least in part on the one or more ambient environmental conditions being outside of a defined threshold operating range of environmental conditions.

BRIEF DESCRIPTION OF THE FIGURES

FIG. 5 shows an example table of engine operating parameters corresponding to a plurality of throttle levels.

FIG. 6A shows an example table of variation of base timing with engine speed and engine power.

FIG. 6B shows an example table of variation of rail pressure with engine speed and engine power.

DETAILED DESCRIPTION

Figure 1:
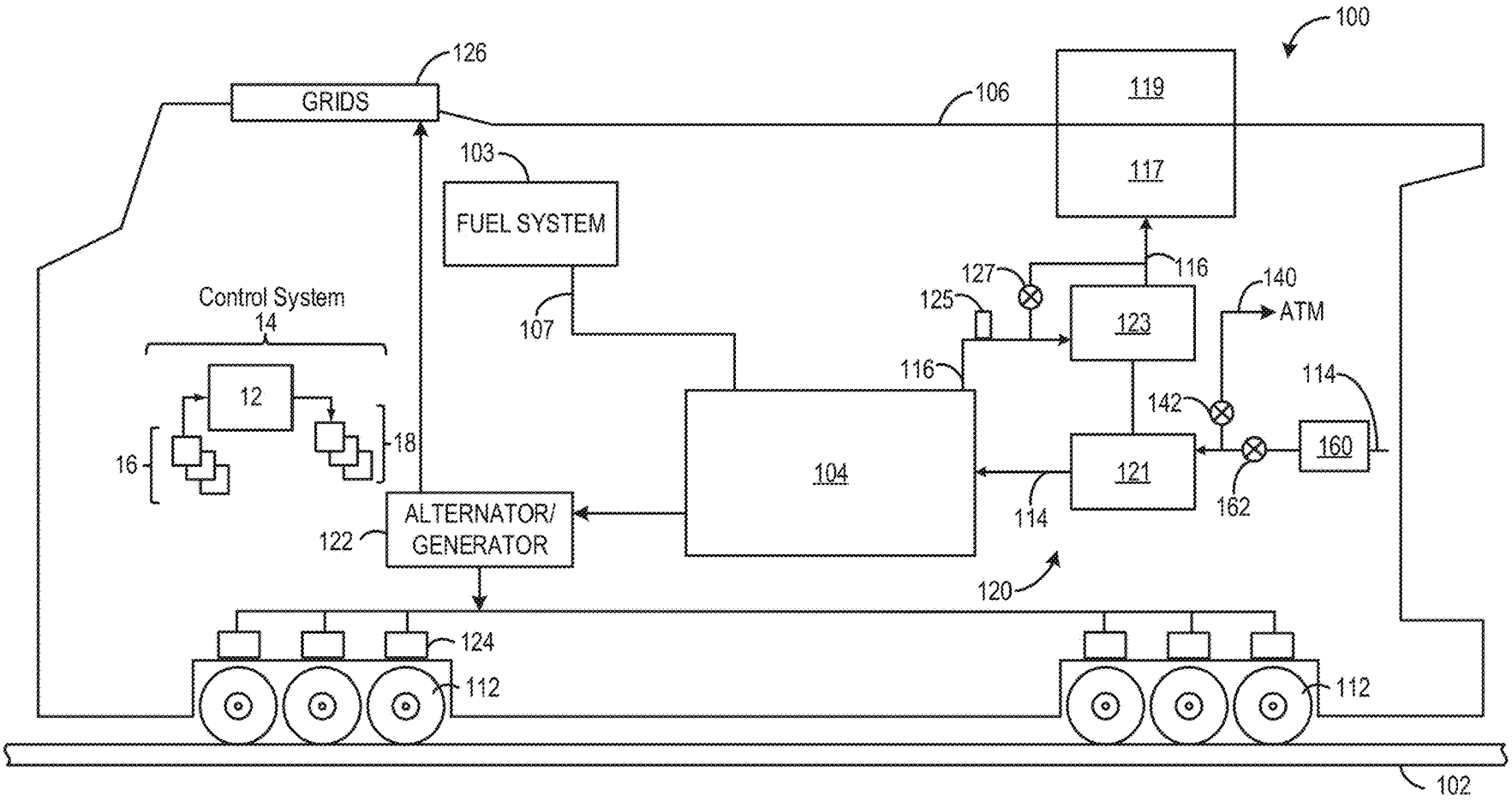
FIG. 1 shows a schematic diagram of a vehicle including an internal combustion engine, according to an embodiment of the invention.

The following description relates to a system and method for the estimation, adjustment, and/or operation of one or more engine parameters in an engine operating over a range of ambient conditions, including some extreme conditions. Various engines and end-use applications are contemplated herein. Suitable engines may include those powered by gasoline, diesel, biodiesel, ethanol, natural gas, and any combination of two or more of the foregoing. Suitable engine systems may include vehicles such as automobiles, trucks, mining and industrial equipment, locomotives and rail vehicles, marine vessels, and aircraft, as well as in some instances stationary power generators.

Rail vehicles may be used to move railcars, and for assembling and disassembling trains in a railyard. Some vehicles may have determined throttle levels that are optimized or otherwise desirable operational points for engines therein. In rail vehicles, these determined throttle levels may be referred to as "notches." In one example, "notch" may correspond to a distinct speed and load setpoint. Other engine applications may employ this "notch" technique where the engine is physically decoupled from the load but is coupled to a generator or alternator.

In one embodiment, a system and method may account for engine models originally calibrated for smaller variations in temperature conditions as used in an engine operating at higher power ratings during conditions of extreme variations for engines operating at relatively lower power ratings.

In one embodiment, a system is provided that includes an engine and a controller for the engine. The engine may include a plurality of cylinders organized into two cylinder banks. The controller may obtain one or more ambient environmental conditions from one or more sensors. The controller may receive, from an operator, for example, a desired throttle level for the engine. With the desired throttle level, the controller may access an engine operating map for base engine operating parameters. These base engine operating parameters that the controller obtains may be one or more determined engine operating parameters for the engine that are based at least in part on the desired throttle level. The controller may then change the one or more determined engine operating parameters obtained from the engine operating map based at least in part on the obtained ambient environmental conditions being outside of a defined threshold operating range of environmental conditions. The threshold operating range may define extremes of the environment. For example, an extreme environment may be a temperature that is outside of a threshold operating range of temperatures, e.g., greater than about 50 degrees Celsius or less than about negative 50 degrees Celsius. In one embodiment, the controller may assess a normal operating mode of the engine by receiving engine operating parameters corresponding to the normal operating mode and, in response to an extreme external temperature, may adjust the engine operating parameters in a defined and determined manner. The adjustment may differ depending on an engine RPM (e.g., an engine speed) or other factors as set out herein.

In one embodiment, the engine operating parameters may include each of an amount and a pressure of intake air of a first bank of cylinders relative to a second bank of cylinders, and the controller may modify a first operating mode of the first bank differently and independently from a second operating mode of the second bank in response to the obtained ambient environmental conditions being determined to be outside of the defined threshold operating range of environmental conditions. This may be done by, for example, independently controlling a plurality of turbochargers.

Figure 3:
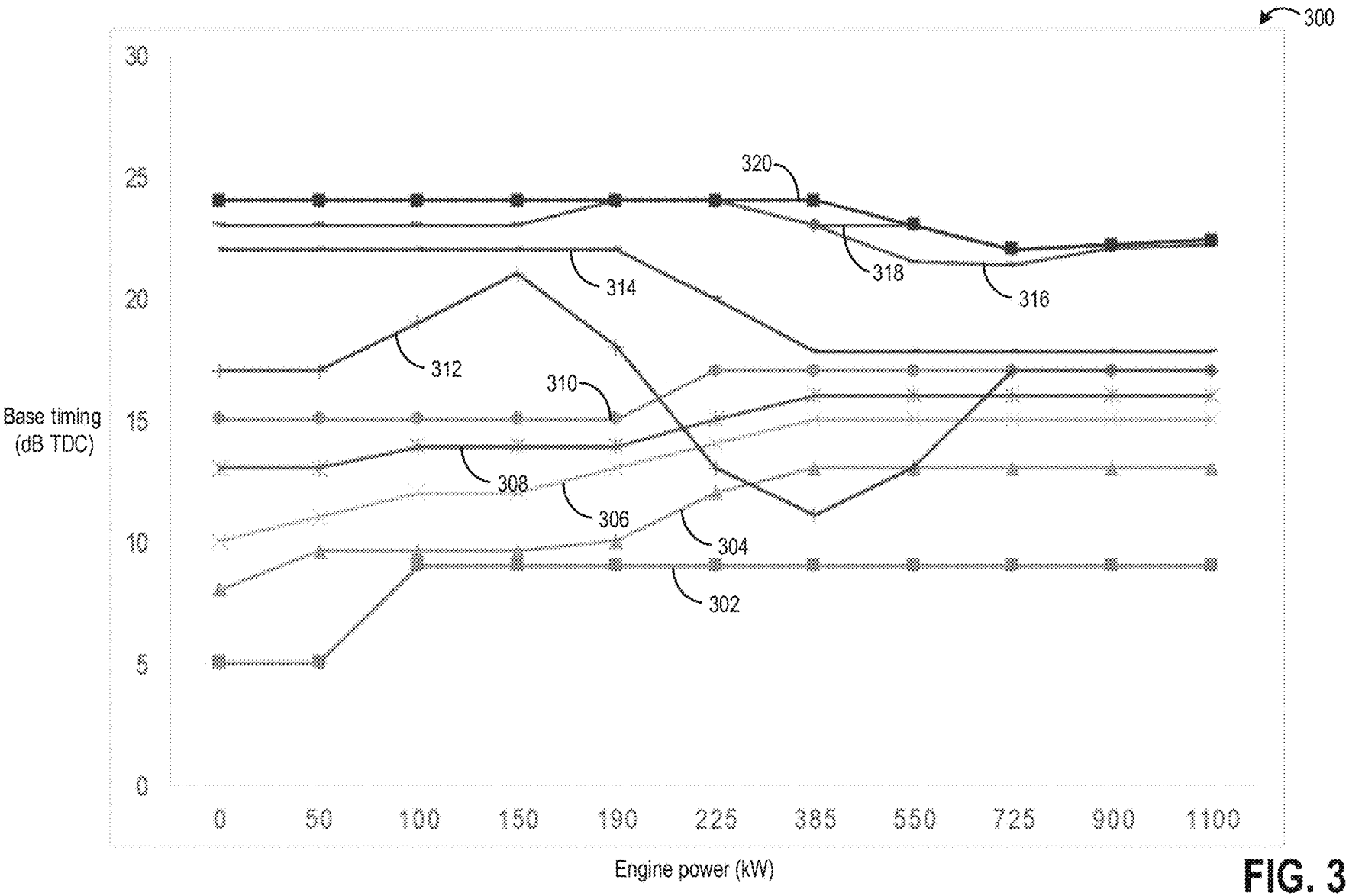
FIG. 3 shows an example plot of variation of base timing with engine power over a plurality of engine speeds.
Figure 4:
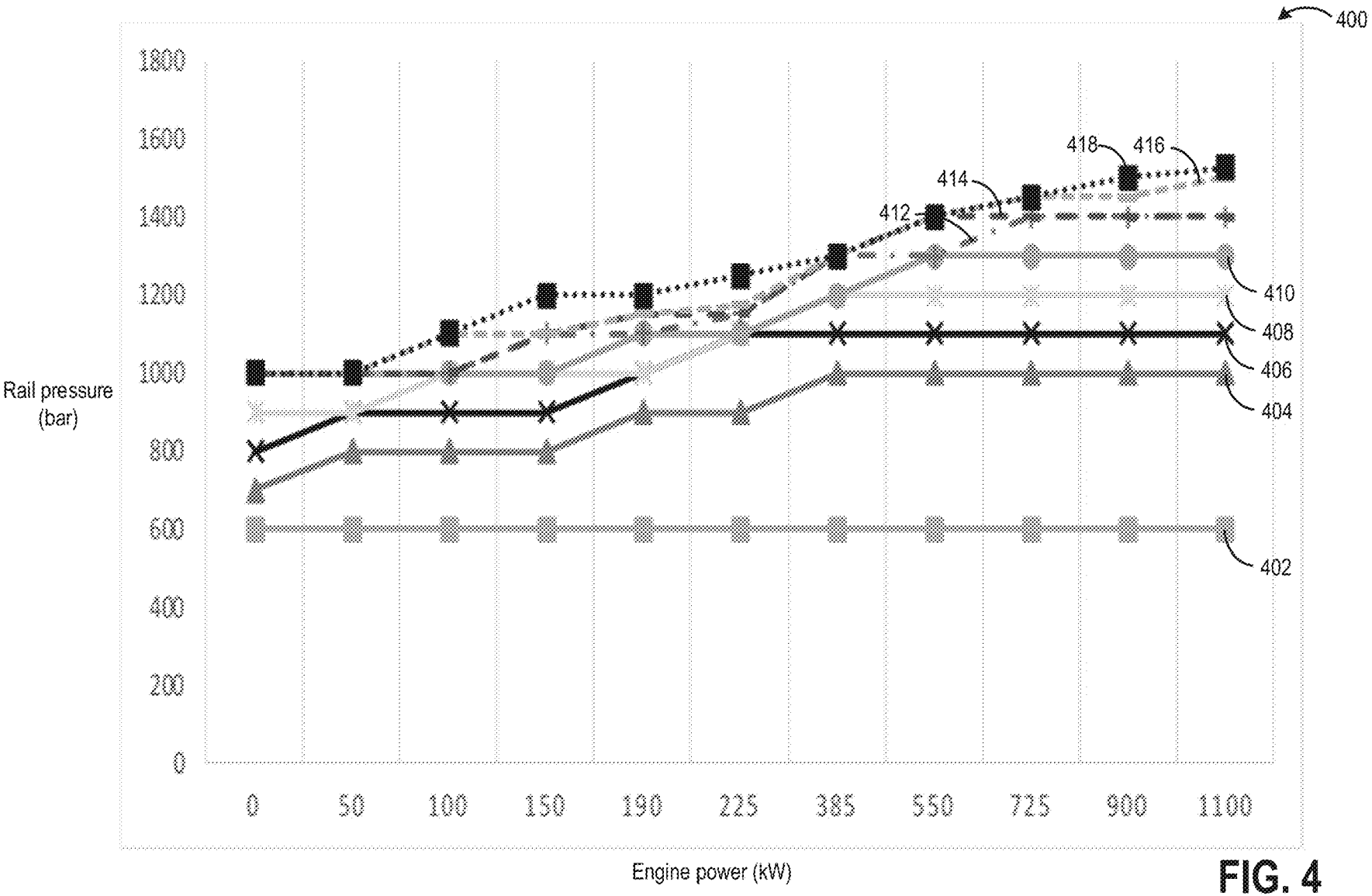
FIG. 4 shows an example plot of variation of fuel common rail pressure with engine power over a plurality of engine speeds.
Figure 7:
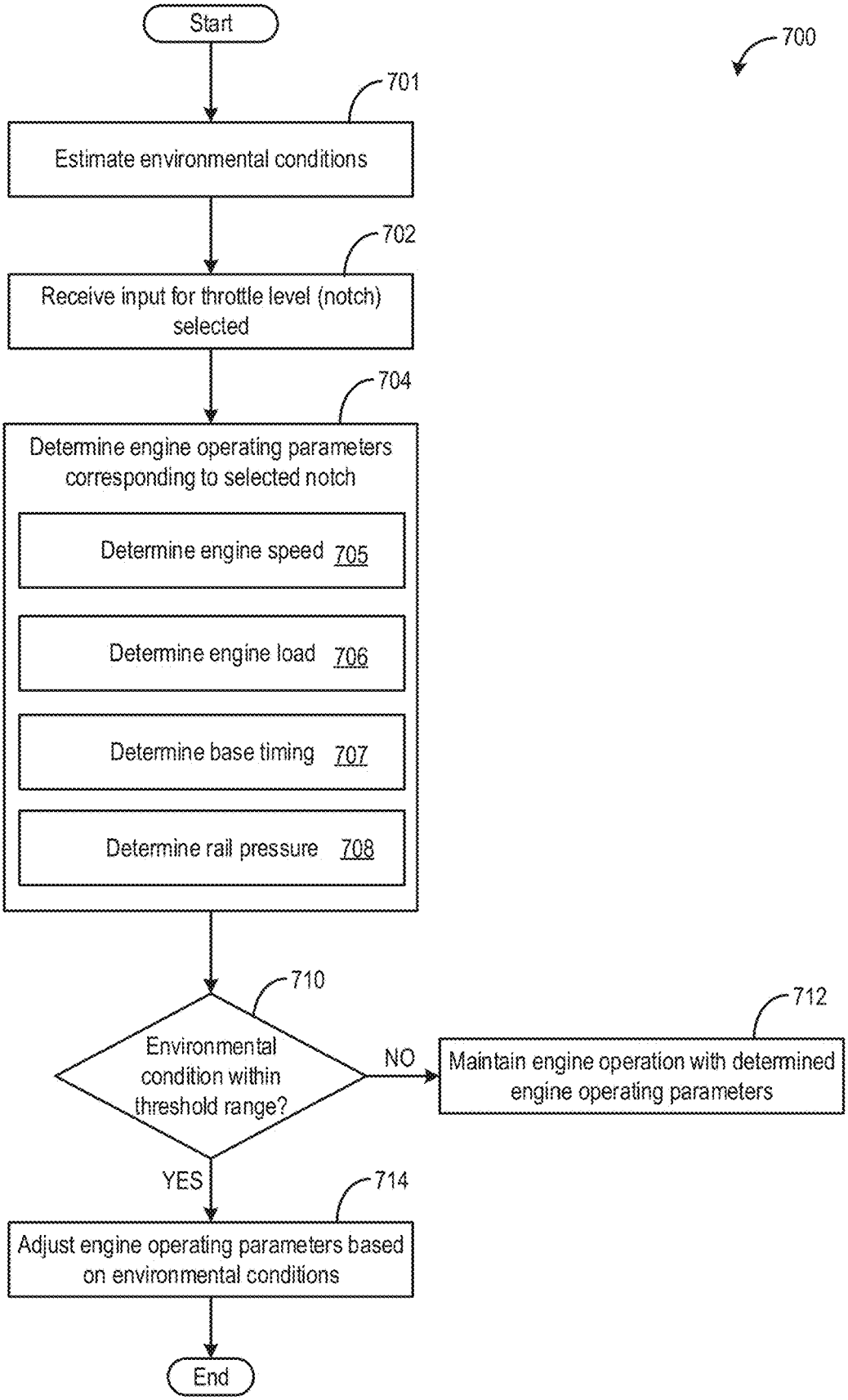
FIG. 7 shows a flow chart illustrating an example method that may be implemented to determine engine operating parameters corresponding to a selected throttle level.
Figure 8:
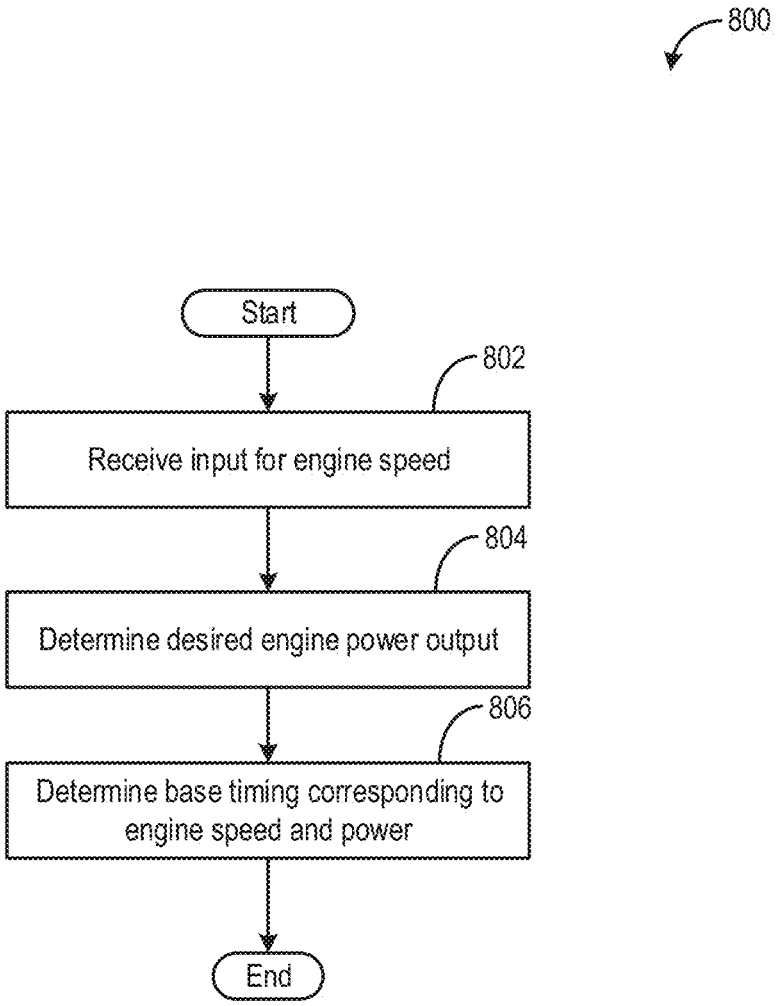
FIG. 8 shows a flow chart illustrating an example method that may be implemented to determine base timing corresponding to an engine speed and an engine power.
Figure 9:
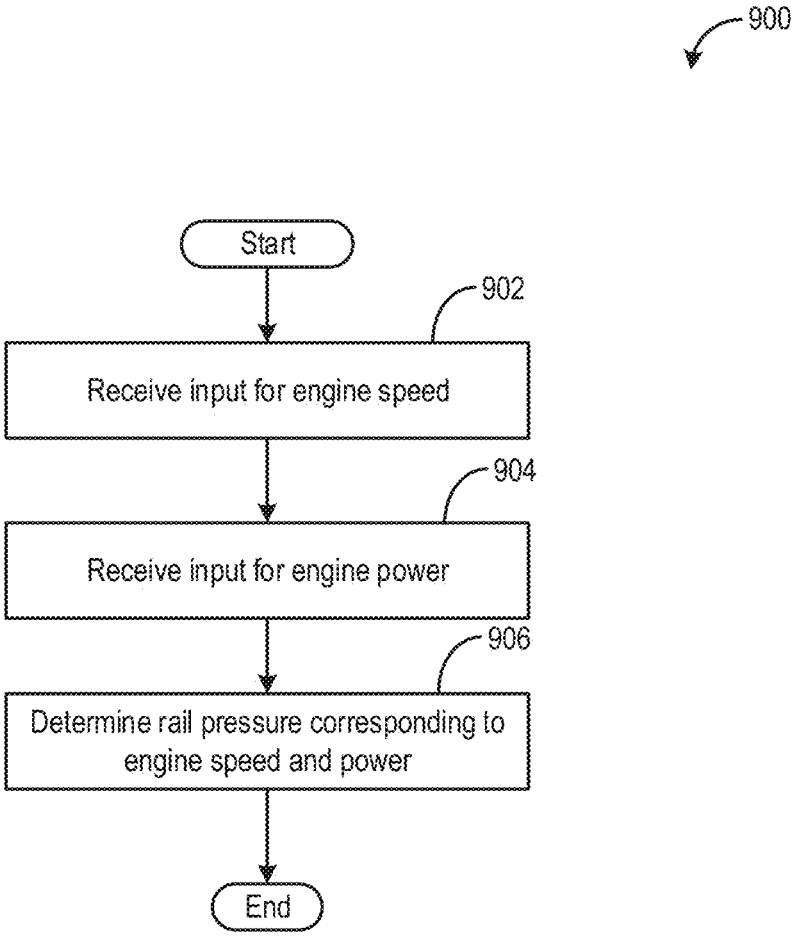
FIG. 9 shows a flow chart illustrating an example method that may be implemented to determine rail pressure corresponding to an engine speed and an engine power.

According to an embodiment, an engine system as shown in FIG. 1 may be mounted in a vehicle to supply power thereto. Variations in a series of engine operating parameters corresponding to each throttle level in an exemplary set of throttle levels is shown in FIGS. 2A-2D and 5. Base timing of the engine may be obtained corresponding to an engine power and an engine speed, as shown in FIGS. 3 and 6A. Fuel that is supplied to the engine may be supplied through a single fuel pump per cylinder, or through a common rail fuel system. Suitable rail pressures may be obtained corresponding to an engine power and an engine speed, as shown in FIGS. 4 and 6B. During operation, an engine controller may perform a control routine to determine engine operating conditions from a calibrated engine map. An example routine is shown in FIGS. 7-9.

The engine may operate at a relatively lower power rating, and the operation may be under extreme environmental conditions. Extreme environmental temperature may be nearer the outer boundaries of operating temperatures. On the cold side, extreme cold may approach and exceeds negative 50 degrees Celsius as a threshold temperature. On the hot side, extreme heat may approach and exceed 50 degrees Celsius as a threshold temperature. These temperatures may be further affected by extremes of humidity, pressure, and the like. In one embodiment, the contemplated system and method may reduce fuel consumption and exhaust emissions levels of some exhaust constituents during operation.

During operation, a throttle level (also refereed herein as a notch) may be selected by an operator via a notch selection handle. This may indirectly or directly control one or more of an engine speed, an engine load, a base timing, and a fuel common rail pressure (e.g., from a pre-calibrated engine map at selected ambient temperature conditions). By selecting and/or adjusting one or more engine operating parameters (e.g., from the engine map) for environmental conditions above or below threshold values, engine performance may be improved.

An engine controller 12 (referred to herein as the controller) may form part of a control system 14 for the vehicle. The control system may control various components related to the vehicle. As an example, various components of the vehicle may be coupled to the controller via a communication channel or data bus. The controller may additionally or alternatively include a memory holding non-transitory computer readable storage media (not shown) including code for enabling on-board monitoring and control of vehicle operation.

The controller may receive information from one or more of a plurality of sensors 16. Further, the controller may send control signals to a plurality of actuators 18. The controller, while overseeing control and management of the vehicle, may receive signals from the sensors to determine operating parameters and operating conditions, and may correspondingly adjust various engine actuators to control operation of the vehicle. For example, the engine controller may receive signals from various engine sensors including, but not limited to, engine speed (e.g., via an engine crankshaft position sensor), engine load (e.g., derived from fueling quantity commanded by the engine controller, fueling quantity indicated by measured fuel system parameters, averaged mean-torque data, and/or electric power output from an alternator or generator), mass airflow amount/rate (e.g., via a mass airflow meter), intake manifold air pressure, boost pressure, exhaust pressure, ambient pressure, ambient temperature, ambient humidity, exhaust temperature (e.g., the exhaust temperature entering the turbine, as determined from a temperature sensor), particulate filter temperature, particulate filter back pressure, engine coolant pressure, exhaust oxides-of-nitrogen quantity (e.g., from a NOx sensor), exhaust soot quantity (e.g., from a soot/particulate matter sensor), exhaust gas oxygen level, or the like. Correspondingly, the controller may control the rail vehicle by sending commands to various components such as traction motors, the alternator/generator, cylinder valves, fuel injectors, a throttle level throttle or notch selection handle, a compressor bypass valve (or an engine bypass valve in alternate embodiments), a wastegate, or the like. Other actively operating and controlling actuators may be coupled to various locations in the rail vehicle.

As one example, an engine map may be populated with engine operating parameters corresponding to each throttle level. The engine operating parameters may be optimized or otherwise pre-adjusted for an engine operating at a lower power rating. Also, the engine operating parameters may be used over a wide range of environmental temperature conditions. A plurality of tables and plots may be populated correlating the engine operating parameters, and the tables and plots may be saved in the memory of the controller. During engine operation, an engine operator may select a throttle level and the engine controller may use the engine map to determine corresponding engine operating conditions for the selected throttle level. Also, during engine operation at a certain engine speed, the controller may use the engine map to determine engine operating parameters corresponding to each engine power.

By selecting engine operating parameters from an engine map populated for an engine operating at a lower power rating and over a range of environmental conditions, engine operation may be controlled by adjusting those operating parameters based at least in part on (measured or calculated) environmental conditions. The technical effect of selecting engine operating conditions from the engine map corresponding to a throttle level selected by the operator, and then adjusting those operating conditions based at least in part on measured or calculated environmental conditions, is that fuel consumption may be reduced. By adjusting engine operating parameters relative to base or expected engine operating parameters in response to measured or calculated environmental conditions, such as during environmental temperature conditions that are above or below respective threshold values, emissions levels may be reduced. By populating an engine map and using the engine map during all operating conditions, engine operation may be carried out for warm and cold engines across a range of throttle levels, engine speeds, and power load scenarios.

Referring to FIG. 1, a block diagram is shown of an embodiment of a rail vehicle system 100 that can run on a rail 102 while powered by an engine 104. In the illustrated embodiment, the vehicle system is depicted as a rail vehicle 106 having a plurality of wheels 112. A suitable rail vehicle may be a shunter and the engine would be a shunter engine. In this embodiment, the engine may be operated at a relatively low power rating as compared to engines in vehicles used for moving trains over long distances. As an example, the engine may be operated at a power rating of 1100 kW/1475 hp while the engine may be capable of operating at 2500 horsepower (hp) output. In this embodiment, the engine may be used in geographical locations with extreme (high and low) environmental temperatures.

A suitable engine may include a plurality of combustion chambers (e.g., cylinders). The cylinders of the engine receive fuel (e.g., diesel fuel) from a fuel system 103 via a fuel conduit 107. The fuel conduit may be coupled with a fuel common rail and a plurality of fuel injectors. A pressure of the fuel common rail may be adjusted based on engine operating parameters and a throttle level selected by the engine operator. The fuel common rail pressure may be monitored based on a fuel common rail pressure sensor coupled to the fuel common rail.

The engine receives intake air for combustion from an intake passage 114. The intake air includes ambient air from outside of the vehicle flowing into the intake passage through an air filter 160. The intake passage may include a throttle 162 having a throttle plate. In this example, the position of the throttle plate may be varied by the controller via a signal provided to an electric motor or actuator included with the throttle. The throttle may open to a plurality of distinct positions, each position corresponding to a throttle level. In this manner, the throttle may be operated to vary the intake air provided to the combustion chamber in the engine. As an example, the throttle control may have eight positions (as in "notches"), plus an idle position. Throttle level 1 (first throttle level) may correspond to a minimum amount of intake air and fuel being supplied to the engine while and throttle level 8 (eighth throttle level) may correspond to a highest amount of intake air and fuel being supplied to the engine, with throttle levels 2 through 7 (second through seventh throttle levels) increasing in an amount of intake air and fuel supplied to the engine in a sequential, stepwise manner between throttle levels 1 and 8. The engine operator may select the throttle level via actuation of a switch or a pedal. The intake passage may include and/or be coupled to an intake manifold of the engine. Exhaust gas resulting from combustion in the engine is supplied to an exhaust passage 116. Exhaust gas flows through the exhaust passage, to a muffler 117, and out of an exhaust stack 119 of the vehicle.

Each cylinder of engine may include one or more intake valves and one or more exhaust valves. For example, a cylinder may include at least one intake valve and at least one exhaust valve located at an upper region of the cylinder. The intake valve and the exhaust valve may be actuated via respective cam actuation systems coupled to respective rocker arm assemblies. Cam actuation systems may each include one or more cams and may utilize one or more of cam profile switching (CPS), variable cam timing (VCT), variable valve timing (VVT), and/or variable valve lift (VVL) systems that may be operated by the controller to vary valve operation. The positions of the intake valve and the exhaust valve may be determined by valve position sensors. In alternative embodiments, the intake and/or exhaust valve may be controlled by electric valve actuation. For example, a cylinder may alternatively include an intake valve controlled via electric valve actuation and an exhaust valve controlled via cam actuation including CPS and/or VCT systems.

In one example, the rail vehicle is a diesel-electric vehicle. As depicted in FIG. 1, the engine may be coupled to an electric power generation system, which may include an alternator/generator 122. The alternator may be electrically coupled to one or more electric traction motors 124. In some embodiments, various power electronics components and bus elements may be interposed between the alternator and traction motor. A suitable alternator/generator may include a direct current (DC) generator or an alternating current (AC) alternator. As noted, suitable engines may include a gasoline, diesel, and/or natural gas engine that generates a torque output that is transmitted to the electric alternator/generator. The alternator/generator may be mechanically coupled to the engine. The engine may be a multi-fuel engine. Suitable multi-fuel engines may include those operating with both diesel fuel and natural gas. Other suitable engines may use other straight/mono fuels such as gasoline, diesel, or natural gas, or may use various combinations of fuels other than diesel and natural gas.

The engine system may include a turbocharger 120. The turbocharger may be arranged between the intake passage and the exhaust passage. In alternate embodiments, the turbocharger may be replaced with a supercharger. The turbocharger increases the pressure of an air charge of ambient air drawn into the intake passage to provide greater charge density during combustion to increase power output and/or engine-operating efficiency. As shown in FIG. 1, the turbocharger includes a compressor 121 (disposed in the intake passage) which is at least partially driven by a turbine 123 (disposed in the exhaust passage). While in this case a single turbocharger is included, the system may include multiple turbine and/or compressor stages. The turbine is driven by the engine exhaust gas which enters via a gas inlet casing of the turbocharger. The gas expands through a nozzle ring of the turbocharger where the pressure energy of the gas is converted to kinetic energy. This high velocity gas is directed onto the turbine blades where it drives a turbine wheel, and consequently the compressor, at high speeds. The exhaust gas then passes through the outlet casing of the turbine to the exhaust passage. Since the engine may be used at a lower power rating and at extreme environmental weather conditions, a higher intake airflow may be desired for fuel consumption and exhaust temperature. The nozzle ring hardware may provide the increased airflow as desired. A temperature sensor 125 may be positioned in the exhaust passage, upstream of an inlet of the turbine.

In the illustrated embodiment, six pairs of traction motors correspond to each of six pairs of motive wheels of the vehicle. A suitable electrical system may be coupled to one or more resistive grids 126. The resistive grids may dissipate engine torque and/or kinetic traction motor energy via heat produced by the grids. In other alternative embodiments, the vehicle may include a battery bank, a fuel cell, and/or equipment that allows the vehicle to connect to an electrical grid via a third rail or catenary line. Electrical energy from the alternator/generator, the traction motors (operating in dynamic braking mode), and/or the grid connection equipment may be controlled by the system to store energy and/or propel the vehicle.

As shown in FIG. 1, a wastegate 127 may be disposed in a bypass passage around the turbine and may be adjusted, via actuation from the controller, to increase or decrease exhaust gas flow through the turbine. For example, opening the wastegate (or increasing an amount of opening) may decrease exhaust gas flow through the turbine and correspondingly decrease the rotational speed of the compressor. As a result, less air may enter the engine, thereby decreasing the combustion air-fuel ratio. The engine system may include a compressor bypass passage 140. The passable may couple directly to the intake passage, upstream of the compressor and upstream of the engine. In one example, the compressor bypass passage may be coupled to the intake passage, upstream of the intake manifold of the engine. The compressor bypass passage is configured to divert airflow (e.g., from before the compressor inlet) away from the engine (or intake manifold of the engine) and to atmosphere. A compressor bypass valve (CBV) 142 is positioned in the compressor bypass passage and includes an actuator actuatable by the controller to adjust the amount of intake airflow diverted away from the engine and to atmosphere.

In some embodiments, the engine system may include an aftertreatment system coupled in the exhaust passage upstream and/or downstream of the turbocharger. In one embodiment, the aftertreatment system may include a diesel oxidation catalyst (DOC) and a diesel particulate filter (DPF). In other embodiments, the aftertreatment system may additionally or alternatively include one or more emission control devices. Such emission control devices may include a selective catalytic reduction (SCR) catalyst, a three-way catalyst, a NOx trap, or various other devices or systems. While the engine system shown in FIG. 1 does not include an exhaust gas recirculation (EGR) system, in alternate embodiments the engine system may include an EGR system. If present, the EGR system may route exhaust gas from the exhaust passage of the engine to the intake passage downstream of the turbocharger. In some embodiments, the EGR system may be coupled to a determined group of one or more donor cylinders of the engine (also referred to as a donor cylinder system).

The engine may be operated based on a throttle level (or notch) selected by the engine operator and a pre-calibrated engine map which may be used as a black box transfer function by the controller. As an example, one or more engine operating parameters may be estimated at various environmental conditions from a set of calibration tables during engine operation at a power output at or below approximately (such as within ±5% variation) 1100 kW, the set of calibration tables including each of a first calibration table for estimation of an engine speed, an engine load, a base timing, and a fuel common rail pressure corresponding a selected throttle level, a second calibration table for estimation of a base timing corresponding to an estimated engine speed and an estimated engine power, and a third calibration table for estimation of a fuel common rail pressure corresponding to an estimated engine speed and an estimated engine power.

FIG. 7 shows a flow chart of a method 700 for determining engine operating conditions corresponding to a selected throttle level of an engine operating at a lower than maximal power rating. An engine map, model, or lookup table may be pre-calibrated and stored in memory of a controller such that engine operating parameters corresponding to each selected throttle level may be obtained independent of extreme environmental conditions. Instructions for carrying out the method and the rest of the methods included herein (e.g., methods 800 and 900 described in detail below with reference to FIGS. 8 and 9) may be executed by a controller (e.g., the controller of FIG. 1) based on instructions stored on a memory of the controller and in conjunction with signals received from sensors of the engine system, such as the sensors described above with reference to FIG. 1. The controller may employ engine actuators of the engine system, such as the actuators described above with reference to FIG. 1, to adjust engine operation according to the methods described below.

At 701, the method 700 may include estimating ambient environmental conditions including ambient temperature, pressure, humidity, etc. based on inputs from one or more sensors coupled to the engine.

At 702, the method 700 may include receiving an input of a throttle level (notch) selected by an operator of the engine. The operator may select the throttle level via a switch on a control panel of the engine or by engaging a pedal or a lever to a specific position. As an example, the engine may have numbered throttle levels (notches) and an idle throttle level. The operator may change operation from one throttle level to another during operation of the engine.

Once the input of the selected throttle level is received by the controller, at 704, the method 700 may include determining a set of engine operating parameters corresponding to the selected throttle level (e.g., optimized for engine operation at the selected throttle level and environmental conditions). Selection of a higher throttle level may correspond to a larger opening of an air intake and a larger fuel delivery to the engine. Correspondingly, selection of a lower throttle level (e.g., lower than the higher throttle level) may correspond to a smaller opening of the air intake and a smaller fuel delivery to the engine.

Determination of engine operating parameters may include, at 705, determining an engine speed corresponding to the selected throttle level. The controller may use a plot or a table of the engine map as initial input to determine the engine speed for operating the engine (e.g., at a lower power rating) over a wide variation of environmental temperatures. In one example, the engine may be operated only as a shunter engine (e.g., at lower power ratings).

Figure 2A:
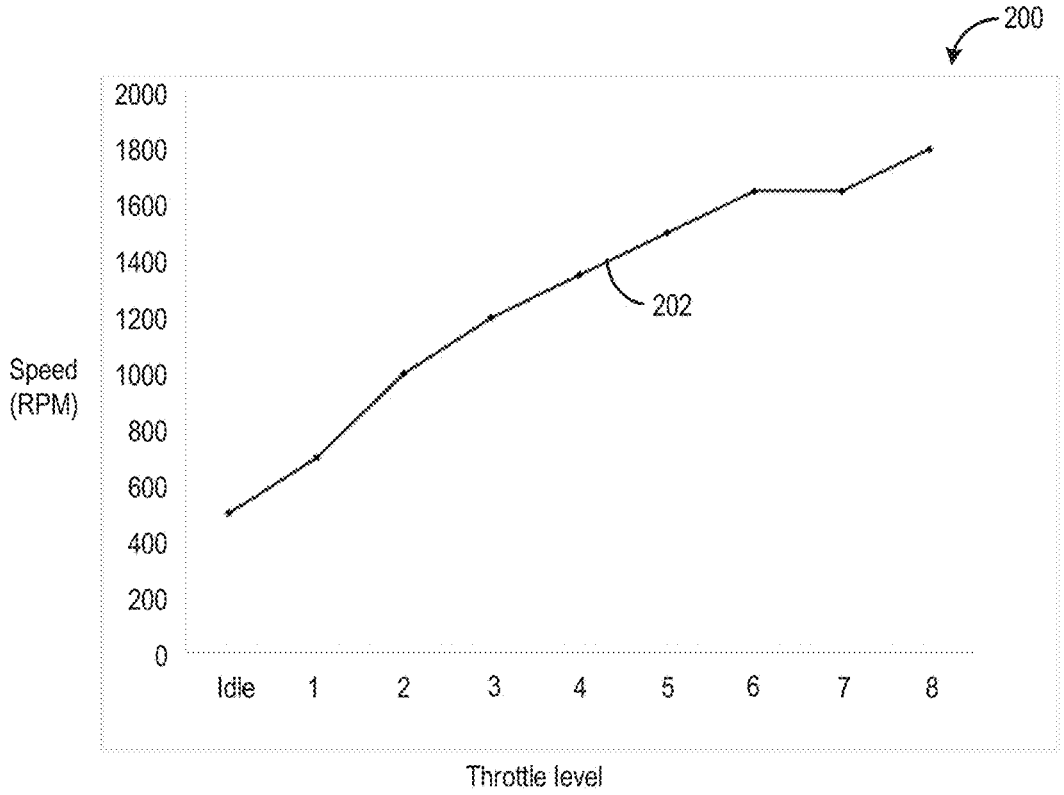
FIG. 2A shows an example plot of variation in engine speed with throttle level.

FIG. 2A shows an example calibrated plot 200 relating engine speed to throttle level. The plot 200 may be part of the calibrated engine map. The x-axis denotes the throttle level and the y-axis denotes the engine speed (in RPM). The controller may use the selected throttle level as input to retrieve a corresponding engine speed from the plot 200. The engine speed, as shown by line 202, may be maintained or increase with an increase in throttle level, with the engine speed being lowest at idle and highest at throttle level 8. The engine speed may increase from approximately (such as within ±5% variation) 500 RPM at idle to approximately (such as within ±5% variation) 1800 RPM at throttle level 8. In one example, the engine speed may be adjusted in a stepwise manner from 500 RPM at idle to 700 RPM at throttle level 1 to 1000 RPM at throttle level 2 to 1200 RPM at throttle level 3 to 1350 RPM at throttle level 4 to 1500 RPM at throttle level 5 to 1650 RPM at throttle level 6, maintained at 1650 RPM at throttle level 7 and adjusted therefrom to 1800 RPM at throttle level 8. In one example, a rate of increase in engine speed may be lower corresponding to the two lowest throttle levels (e.g., idle and throttle level 1) and two highest throttle levels (e.g., throttle levels 7 and 8) relative to the rate of increase at the intermediate throttle levels (e.g., throttle levels 3 through 6). In another example, the rate of increase in engine speed may be higher between the idle and the three next lowest throttle levels (e.g., throttle levels 1 to 3) relative to the rate of increase between the six highest throttle levels (e.g., throttle levels 3 to 8).

Determination of engine operating parameters may include, at 706, determining an engine load corresponding to the selected throttle level. The controller may use a plot or a table of the engine map as initial input to determine the engine load for operating the engine (e.g., at a lower power rating) over a wide variation of environmental temperatures.

Figure 2B:
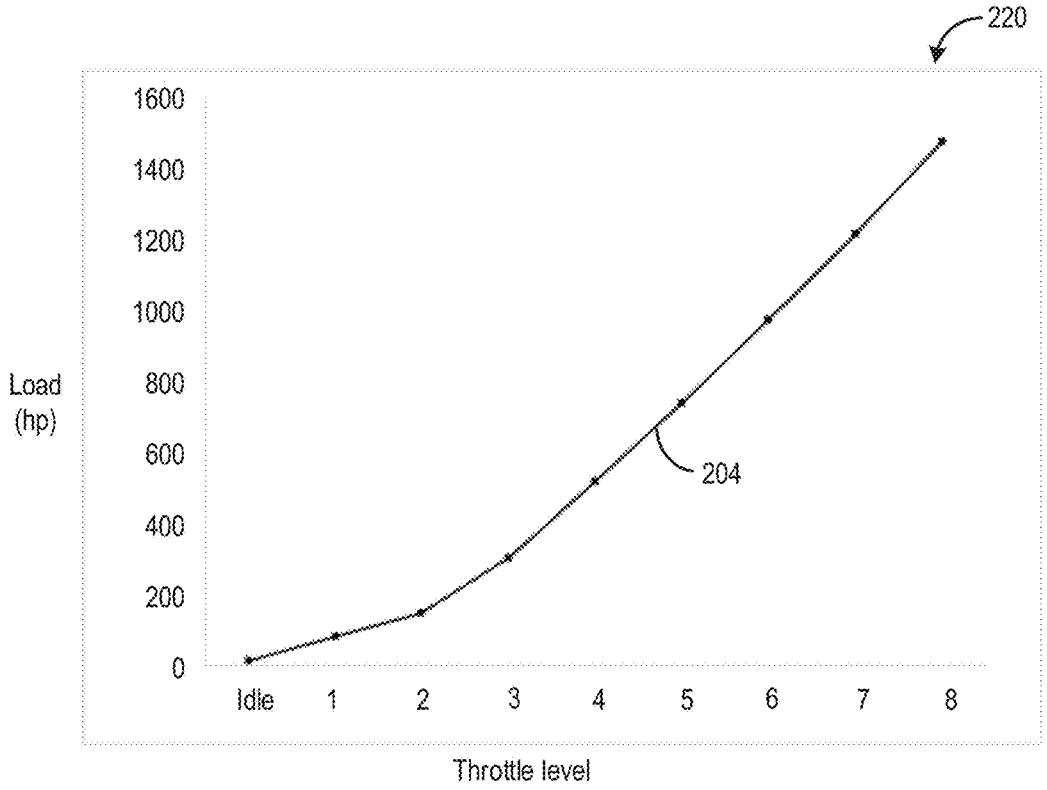
FIG. 2B shows an example plot of variation in engine load with throttle level.

FIG. 2B shows an example calibrated plot 220 relating engine load to throttle level. The plot 220 may be part of the calibrated engine map. The x-axis denotes the throttle level and the y-axis denotes the engine load (associated with hp). The controller may use the selected throttle level as input to retrieve a corresponding engine load from the plot 220. The engine load, as shown by line 204, may increase with an increase in throttle level, with the engine load being lowest at idle and highest at throttle level 8. The engine load may be approximately (such as within ±5% variation) 11 hp at idle throttle level and increase to approximately (such as within ±5% variation) 1475 hp at throttle level 8. Even though the engine is capable of operating at a higher power rating, in order to operate the engine as a shunter engine, a lower power rating may be used. In one example, the engine load may be adjusted in a stepwise manner from 11 hp at idle to 80 hp at throttle level 1 to 145 hp at throttle level 2 to 302 hp at throttle level 3 to 516 hp at throttle level 4 to 738 hp at throttle level 5 to 972 hp at throttle level 6 to 1214 hp at throttle level 7 to 1475 hp at throttle level 8. In one example, a rate of increase in engine load may be lower corresponding to the two lowest throttle levels relative to the rate of increase at the higher throttle levels.

Determination of engine operating parameters may include, at 707, determining a base timing corresponding to the selected throttle level. In a diesel engine, the base timing may be a timing, relative to a current piston position and crankshaft angle, for injection of fuel into the combustion chamber. Base timing may be measured relative to a top dead center (TDC) position of the piston in the combustion chamber. The base timing may be measured in crankshaft angle relative to the TDC position. The controller may use a plot or a table of the engine map to determine the base timing for operating the engine (e.g., at a lower power rating) over a wide variation of environmental temperatures.

Figure 2C:
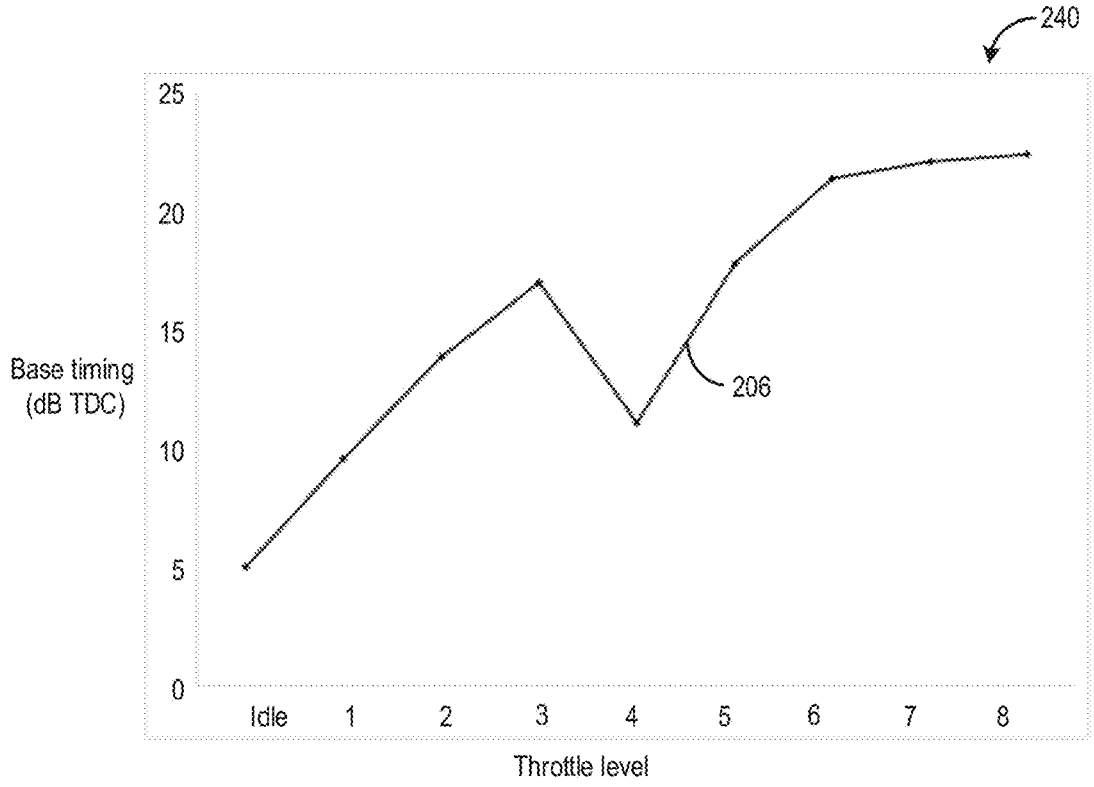
FIG. 2C shows an example plot of variation in base timing with throttle level.

FIG. 2C shows an example calibrated plot 240 relating base timing to throttle level. The plot 240 may be part of the calibrated engine map. The x-axis denotes the throttle level and the y-axis denotes the base timing (in dB TDC). The controller may use the selected throttle level as input to retrieve a corresponding base timing from the plot 240. Advancing the base timing relative to TDC may result in increased engine power output. The base timing, as shown by line 206, may increase until a threshold throttle level is reached at which the base timing may decrease, and then above the threshold throttle level the base timing may increase. In this example, the threshold throttle level is 4, such that the base timing increases from idle to throttle level 3, decreases at throttle level 4, and then again increases from throttle level 5 to throttle level 8. The base timing may increase from approximately (such as within ±5%) 5 dB TDC at idle throttle level to approximately (such as within ±5%) 17 dB TDC at a lower throttle level, decrease to approximately (such as within ±5%) 11.1 dB TDC at an intermediate throttle level, and then increase to approximately (such as within ±5%) 22.4 dB TDC at a higher throttle level. In one example, the base timing may be adjusted in a stepwise manner from 5 dB TDC at idle to 9.6 dB TDC at throttle level 1 to 13.9 dB TDC at throttle level 2 to 17 dB TDC at throttle level 3 to 11.1 dB TDC at throttle level 4 to 17.8 dB TDC at throttle level 5 to 21.4 dB TDC at throttle level 6 to 22.1 dB TDC at throttle level 7 to 22.4 dB TDC at throttle level 8. In one example, the base timing may stabilize (e.g., with a lower rate of change) at higher throttle levels (e.g., throttle levels 7 and 8) relative to lower throttle levels (e.g., idle and throttle levels 1 through 6).

Determination of engine operating parameters may include, at 708, determining a fuel common rail pressure corresponding to the selected throttle level. In a diesel engine, the fuel common rail pressure (also referred to herein as "rail pressure") may be a pressure of a high-pressure fuel common rail of a high-pressure common rail direct fuel injection system supplying fuel to the combustion chambers via valves/injectors coupled to the high-pressure fuel common rail. A higher fuel common rail pressure may correspond to a higher amount of fuel being delivered to the combustion chamber for a static period of an injector being open. The controller may use a plot or a table of the engine map to determine the fuel common rail pressure for operating the engine (e.g., at a lower power rating) over a wide variation of environmental temperatures.

Figure 2D:
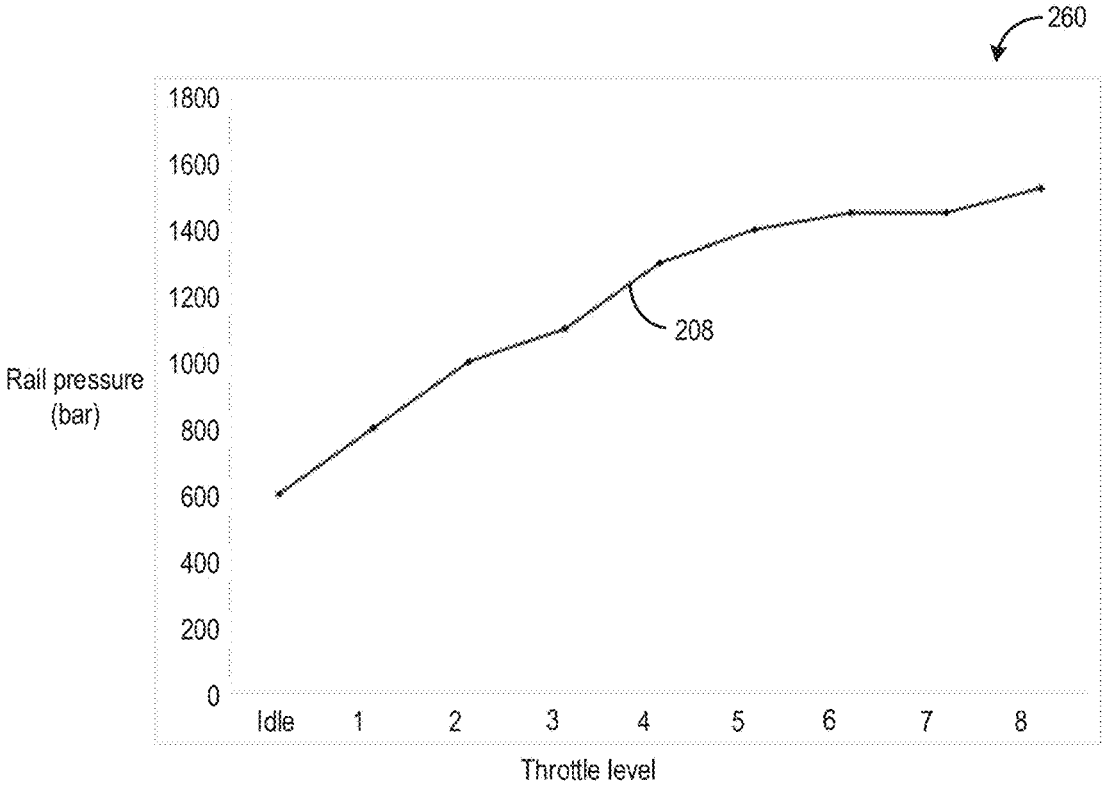
FIG. 2D shows an example plot of variation fuel common rail pressure with throttle level.

FIG. 2D shows an example calibrated plot 260 relating fuel common rail pressure to throttle level. The plot 260 may be part of the calibrated engine map. The x-axis denotes the throttle level and the y-axis denotes the fuel common rail pressure (in bar). The controller may use the selected throttle level as input to retrieve a corresponding fuel common rail pressure from the plot 260. The rail pressure, as shown by line 208, may be maintained or increase with an increase in throttle level, with the fuel common rail pressure being lowest at idle and highest at throttle level 8. The fuel common rail pressure may increase from approximately (such as within ±5% variation) 600 bar at idle throttle level to approximately (such as within ±5% variation) 1525 bar at throttle level 8. In one example, the fuel common rail pressure may be adjusted in a stepwise manner from 600 bar at idle to 800 bar at throttle level 1 to 1000 bar at throttle level 2 to 1100 bar at throttle level 3 to 1300 bar at throttle level 4 to 1400 bar at throttle level 5 to 1450 bar at throttle level 6, maintained at 1450 bar at throttle level 7 and adjusted therefrom to 1525 bar at throttle level 8. In one example, a rate of increase in fuel common rail pressure may be higher between the idle and the next two lowest throttle levels (e.g., throttle levels 1 and 2) relative to the rate of increase between the seven highest throttle levels (e.g., throttle levels 2 through 8).

FIG. 5 shows an example table 500 of engine operating parameters including engine speed 504, engine load 506, base timing 508, and fuel common rail pressure 510 corresponding to throttle level 502. The table (regardless of calibration) may be saved in the controller memory. The table may be used by the controller to determine engine operating conditions corresponding to selected throttle levels. Each of the plots shown in FIGS. 2A-2D are derived from the table. In one example, the controller may be implemented in a shunter locomotive and may only include the table of FIG. 5 for initial determination of the engine speed, the engine load, the base timing, and the fuel common rail pressure at the various throttle levels, which may or may not then be adjusted based on environmental conditions. In this way, the engine map of operating parameters suitable for adjustment responsive to a wide variation of environmental conditions may be saved as plots or tables in the controller memory.

At 710, the method 700 may include determining if one or more environmental conditions are within respective threshold ranges (e.g., lower than or equal to an upper threshold and/or greater than or equal to a lower threshold, the lower threshold less than the upper threshold). As an example, the controller may determine if the ambient temperature is above a pre-determined threshold temperature. In one example, the pre-determined threshold temperature may be 50° C. If it is determined that the environmental conditions are within respective threshold ranges, the method 700 may proceed to 712, where the method 700 may include maintaining engine operation with the engine operating parameters determined at 704. In one example, the engine operating parameters may be actively maintained. In another example, the engine operating parameters may be permitted to deviate within the scope of typical engine operation across selectable throttle levels.

If it is determined that one or more environmental conditions are outside of respective threshold ranges, the method 700 may proceed to 714, where the method 700 may include adjusting the engine operating parameters based on the one or more environmental conditions. In one example, only the engine speed, the engine load, the base timing, and/or the fuel common rail pressure may be actively adjusted based on the one or more environmental conditions and no other engine operating parameters may be adjusted based on the one or more environmental conditions. In an additional or alternative example, the engine speed, the engine load, the base timing, and/or the fuel common rail pressure may initially be determined based on only the selected throttle level and may only be subsequently adjusted based on the one or more environmental conditions or responsive to a new throttle level being selected. As an example, the engine speed determined at 704 may be reduced if the ambient temperature is measured to be greater than the threshold temperature.

FIG. 8 shows a flow chart of a method 800 for determining a base timing corresponding to an engine speed and an engine power. Corresponding to each engine speed, a change in base timing may be calibrated over a range of engine power outputs and saved in the controller memory as part of the engine map. The base timings in the engine map may be used during an environmental condition to achieve engine performance (e.g., a given environmental condition, such as an ambient temperature, may be correlated to a base timing in the engine map based on the engine speed and the engine power).

At 802, the method 800 may include receiving (e.g., at the controller) input from an engine sensor indicating the engine speed. As an example, the engine speed may be estimated based on input from an engine crankshaft position sensor.

At 804, the method 800 may include determining (e.g., via the controller) a desired engine power output. As an example, the desired engine power output may be determined based on a throttle level selected by the engine operator. A table (such as the table 500 in FIG. 5) or plot (such as the plot 220 in FIG. 2B) may be used by the controller to determine the desired engine power output corresponding to the selected throttle level, with the selected throttle level being used as an input and the desired engine power output being an output.

At 806, the method 800 may include determining the base timing (e.g., for fuel injection to a combustion chamber) corresponding to the engine speed and the desired engine power output. The controller may use a table such as (pre-calibrated) table 600 in FIG. 6A to determine the base timing. The table 600 provides a pre-calibrated base timing for a combination of an engine speed in a range of approximately (such as within ±5% variation) 225 RPM to approximately (such as within ±5% variation) 1980 RPM and an engine power in a range of 0 kW to approximately (such as within ±5% variation) 1100 kW. In one example, the table 600 may include only a plurality of base timings as a function of only the engine speed and the engine power. The controller may use a table such as table 600 as a lookup table with the engine speed and the engine power as inputs and the base timing as output. The base timing may change from approximately (such as within ±5% variation) 5 dB TDC at lower engine speed (e.g., 225 RPM) and lower engine power (e.g., 0 kW) to approximately (such as within ±5% variation) 22.4 dB TDC at higher engine speed (e.g., 1980 RPM) and higher engine power (e.g., 1100 kW). In one example, a maximum value of the base timing (e.g., 24 dB TDC) may be realized at higher engine speeds (e.g., 1800 RPM and higher) and lower engine powers (e.g., 385 kW and lower).

In one example, a base timing corresponding to an engine speed and an engine power may be selected from the pre-calibrated table 600, and in response to obtained ambient environmental conditions being outside of a determined range of environmental conditions, engine operation may be increased to a first timing relative to the base timing proportionally with an increase in engine power for each engine speed listed on the table 600 that is below a first determined engine speed threshold, and engine operation may be decreased to a second timing relative to the base timing proportionally with a decrease in engine power for each engine speed listed on the table 600 that is below a determined second threshold engine speed. In one example, the base timing may initially be determined based on only the engine speed and the desired engine power output and subsequently increased to the first timing or decreased to the second timing based on only the obtained ambient environmental conditions being outside of the determined range of environmental conditions.

FIG. 3 shows a plot 300 of variation of base timing (in dB TDC) with engine power (in kW) over a plurality of engine speeds (in RPM). Lines 302, 304, 306, 308, 310, 312, 314, 316, 318, and 320 denote variation in base timing with engine power for a constant engine speed. As an example, line 302 corresponds to engine speeds of both 225 RPM and 500 RPM; line 304 corresponds to an engine speed of 700 RPM; line 306 corresponds to an engine speed of 840 RPM; line 308 corresponds to an engine speed of 1000 RPM; line 310 corresponds to an engine speed of 1200 RPM; line 312 corresponds to an engine speed of 1350 RPM; line 314 corresponds to an engine speed of 1500 RPM; line 316 corresponds to an engine speed of 1650 RPM; line 318 corresponds to an engine speed of 1800 RPM; and line 320 corresponds to an engine speed of 1980 RPM. As indicated by comparing FIGS. 3 and 6A, the plot 300 may be derived from the table 600.

In some examples, for a constant engine speed (e.g., up to a threshold engine speed, such as 1200 RPM or within ±5% variation thereof), the base timing may increase with an increase in the engine power up to a threshold engine power. As an example, at 225 RPM engine speed and 500 RPM engine speed (e.g., line 302), the base timing may increase approximately 80% from 0 to 100 kW threshold engine power and may be maintained constant therefrom to 1100 kW engine power; at 700 RPM engine speed (e.g., line 304), the base timing may increase approximately 62.5% from 0 to 385 kW threshold engine power and may be maintained constant therefrom to 1100 kW engine power; at 840 RPM engine speed (e.g., line 306), the base timing may increase approximately 50% from 0 to 385 kW threshold engine power and may be maintained constant therefrom to 1100 kW engine power; at 1000 RPM engine speed (e.g., line 308), the base timing may increase approximately 23% from 0 to 385 kW threshold engine power and may be maintained constant therefrom to 1100 kW engine power; and at 1200 RPM engine speed (e.g., line 310), the base timing may increase approximately 13% from 0 to 225 kW threshold engine power and may be maintained constant therefrom to 1100 kW engine power. In some examples above the threshold engine speed, such as at 1350 RPM engine speed (e.g., line 312), the base timing may initially increase and then decrease causing no significant (such as no more than 2%) change in base timing from a lowest engine power of 0 kW to a highest engine power of 1100 kW. At engine speeds above 1350 RPM, the base timing may decrease with an increase from a lowest engine power of 0 kW to a highest engine power of 1100 kW. As an example, at 1500 RPM engine speed (e.g., line 314), the base timing may decrease approximately 19% from 0 to 1100 kW engine power; at 1650 RPM engine speed (e.g., line 316), the base timing may decrease approximately 3.5% from 0 to 1100 kW engine power; and at 1800 RPM engine speed and 1980 RPM engine speed (e.g., lines 318 and 320, respectively), the base timing may decrease approximately 6.5% from 0 to 1100 kW engine power.

FIG. 9 shows a flow chart of a method 900 for determining a fuel common rail pressure corresponding to an engine speed and an engine power. Corresponding to each engine speed, a change in fuel common rail pressure may be calibrated over a range of engine power outputs and saved in the controller memory as part of the engine map. The fuel common rail pressures in the engine map may be used during an environmental condition to achieve engine performance (e.g., a given environmental condition, such as an ambient temperature, may be correlated to a fuel common rail pressure in the engine map based on the engine speed and the engine power).

At 902, the method 900 may include receiving (e.g., at the controller) input from an engine sensor indicating the engine speed. As an example, the engine speed may be estimated based on input from an engine crankshaft position sensor.

At 904, the method 900 may include determining (e.g., via the controller) a desired engine power output. As an example, the desired engine power output may be determined based on a throttle level selected by the engine operator. A table (such as the table 500 in FIG. 5) or plot (such as the plot 220 in FIG. 2B) may be used by the controller to determine the desired engine power output corresponding to the selected throttle level, with the selected throttle level being used as an input and the desired engine power output being an output.

At 906, the method 900 may include determining the fuel common rail pressure for fuel injection to a combustion chamber corresponding to the engine speed and the desired engine power output. The controller may use a table such as (pre-calibrated) table 650 in FIG. 6B to determine the fuel common rail pressure. The table 650 provides a pre-calibrated rail pressure (or other base fuel pressure) for a combination of an engine speed in a range of approximately (such as within ±5% variation) 225 RPM to approximately (such as within ±5% variation) 1980 RPM and an engine power in a range of 0 kW to approximately (such as within ±5% variation) 1100 kW. In one example, the table 650 may include only a plurality of base fuel pressures (e.g., a plurality of pre-calibrated rail pressures) as a function of only the engine speed and the engine power. The controller may use a table such as table 650 as a lookup table with the engine speed and the engine power as inputs and the rail pressure (or other base fuel pressure) as output. The rail pressure may change from approximately (such as within ±5% variation) 600 bar at lower engine speed (e.g., 225 RPM) and lower engine power (e.g., 0 kW) to approximately (such as within ±5% variation) 1525 bar at higher engine speed (e.g., 1980 RPM) and higher engine power (e.g., 1100 kW).

In one example, a base fuel pressure in a common rail system (e.g., a base fuel common rail pressure) or a base fuel pressure supplied to a cylinder in the engine that corresponds to an engine speed and an engine power may be selected from the pre-calibrated table 650, and in response to obtained ambient environmental conditions being outside of a determined range of environmental conditions, engine operation may be increased to a first fuel pressure relative to the base fuel pressure proportionally with an increase in engine power for each engine speed listed on the table 650 that is below a first determined engine speed threshold, and engine operation may be decreased to a second fuel pressure relative to the base fuel pressure proportionally with a decrease in engine power for each engine speed listed on the table 650 that is below a determined second threshold engine speed. In one example, the base fuel pressure may initially be determined based on only the engine speed and the desired engine power output and subsequently increased to the first timing or decreased to the second timing based on only the obtained ambient environmental conditions being outside of the determined range of environmental conditions.

FIG. 4 shows a plot 400 of variation of fuel common rail pressure (in bar) with engine power (in kW) over a plurality of engine speeds (in RPM). Lines 402, 404, 406, 408, 410, 412, 414, 416, and 418 denote variation in rail pressure with engine power for a constant engine speed. As an example, line 402 corresponds to engine speeds of both 225 RPM and 500 RPM; line 404 corresponds to an engine speed of 700 RPM; line 406 corresponds to an engine speed of 840 RPM; line 408 corresponds to an engine speed of 1000 RPM; line 410 corresponds to an engine speed of 1200 RPM; line 412 corresponds to an engine speed of 1350 RPM; line 414 corresponds to an engine speed of 1500 RPM; line 416 corresponds to an engine speed of 1650 RPM; and line 418 corresponds to an engine speeds of both 1800 RPM and 1980 RPM. As indicated by comparing FIGS. 4 and 6B, the plot 400 may be derived from the table 650.

In some examples, for a constant engine speed (e.g., up to a threshold engine speed, such as 500 RPM or within ±5% variation thereof), the rail pressure may be maintained constant from a lowest engine power of 0 kW to a highest engine power of 1100 kW. As an example, at 225 RPM engine speed and 500 RPM engine speed (e.g., line 402), the rail pressure may remain substantially constant from 0 kW to 1100 kW engine power. In some examples above the threshold engine speed, the rail pressure may increase with an increase in engine power. For instance, the rail pressure may increase with an increase in the engine power up to a threshold engine power. As an example, at 700 RPM engine speed (e.g., line 404), the rail pressure may increase approximately 43% from 0 to 385 kW threshold engine power and may be maintained constant therefrom to 1100 kW engine power; at 840 RPM engine speed (e.g., line 406), the rail pressure may increase approximately 37.5% from 0 to 225 kW threshold engine power and may be maintained constant therefrom to 1100 kW engine power; at 1000 RPM engine speed (e.g., line 408), the rail pressure may increase approximately 33% from 0 to 385 kW threshold engine power and may be maintained constant therefrom to 1100 kW engine power; at 1200 RPM engine speed (e.g., line 410), the rail pressure may increase approximately 30% from 0 to 550 kW threshold engine power and may be maintained constant therefrom to 1100 kW engine power; at 1350 RPM engine speed (e.g., line 412), the rail pressure may increase approximately 40% from 0 to 725 kW threshold engine power and may be maintained constant therefrom to 1100 kW engine power; and at 1500 RPM engine speed (e.g., line 414), the rail pressure may increase approximately 40% from 0 to 550 kW threshold engine power and may be maintained constant therefrom to 1100 kW engine power. As another example, at 1650 RPM engine speed (e.g., line 416), the rail pressure may increase approximately 50% from 0 to 1100 kW engine power; and at 1800 RPM engine speed and 1980 RPM engine speed (e.g., line 418), the rail pressure may increase approximately 52.5% from 0 to 1100 kW engine power. Additionally or alternatively, the increase in rail pressure at higher engine speeds may be incremental in steps.

A method may be provided for estimating engine operating parameters and, responsive to one or more ambient environmental conditions being outside of respective threshold ranges, adjusting the estimated engine operating parameters based on the one or more ambient environmental conditions. The engine operating parameters may be estimated from a first pre-calibrated table of an engine model for the engine operating at or below a lower engine power output (such as 1100 kW or less) over a wide ambient temperature variation (such as ±50° C.). Suitable engine operating parameters may include one or more of the engine speed, the engine load, the base timing, and the fuel common rail pressure corresponding to a (selected) throttle level. A base timing corresponding to an estimated engine speed and an estimated engine load may be estimated based on a second pre-calibrated table of the engine model and a fuel common rail pressure corresponding to the estimated engine speed and the estimated engine load may be estimated based on a third pre-calibrated table of the engine model.

As used herein, an element or step recited in the singular and preceded with the word "a" or "an" should be understood as not excluding plural of said elements or steps, unless such exclusion is explicitly stated. Furthermore, references to "one embodiment" or "one example" of the invention do not exclude the existence of additional embodiments that also incorporate the recited features. Moreover, unless explicitly stated to the contrary, embodiments "comprising," "including," or "having" an element or a plurality of elements having a particular property may include additional elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for operating an engine, the method comprising:

obtaining one or more ambient environmental conditions;

obtaining a desired throttle level for the engine;

obtaining a first set of determined engine operating parameters, including an engine speed and an engine load, and a second set of determined engine operating parameters, including a base timing and a fuel common rail pressure, based at least in part on the desired throttle level and an engine operating map;

changing the first set of determined engine operating parameters obtained from the engine operating map based at least in part on the one or more ambient environmental conditions being outside of a defined threshold operating range of environmental conditions; and changing the second set of determined engine operating parameters obtained from the engine operating map based on the changed first set of determined engine operating parameters.

2. The method of claim 1, wherein the first set of determined engine operating parameters comprises only an engine speed and an engine load.

3. The method of claim 1, wherein changing the first set of determined engine operating parameters obtained from the engine operating map based at least in part on the one or more ambient environmental conditions being outside of the defined threshold operating range of environmental conditions comprises:

determining if the obtained one or more ambient environmental conditions is a temperature measured to be greater than a determined threshold temperature; and reducing an engine speed responsive to the obtained one or more ambient environmental conditions being the temperature measured to be greater than the determined threshold temperature.

4. The method of claim 1, further comprising increasing a base timing from approximately 5 dB TDC at an idle throttle level to approximately 17 dB TDC at a first throttle level that is higher than the idle throttle level.

5. The method of claim 4, further comprising decreasing the base timing from approximately 17 dB TDC at the first throttle level that is higher than the idle throttle level to approximately 11 dB TDC at a second throttle level that is higher than the first throttle level and lower than a maximum throttle level, wherein the first throttle level is lower than the second throttle level.

6. The method of claim 5, further comprising increasing the base timing from approximately 11 dB TDC at the second throttle level to about 22 dB TDC at the maximum throttle level.

7. The method of claim 1, further comprising:

selecting a base timing corresponding to an engine speed and an engine power from a plurality of base timings in a pre-calibrated first table, the pre-calibrated first table comprising only the plurality of base timings as a function of only the engine speed and the engine power; and responding to the obtained one or more ambient environmental conditions being outside of the defined threshold operating range of environmental conditions by one or more of:

increasing to a first timing relative to the base timing proportionally with an increase in the engine power for each engine speed listed in the pre-calibrated first table that is below a first determined engine speed threshold; and decreasing to a second timing relative to the base timing proportionally with a decrease in the engine power for each engine speed listed in the pre-calibrated first table that is below a second determined engine speed threshold.

8. The method of claim 7, further comprising increasing the base timing from approximately 5 dB TDC corresponding to approximately 50 kW engine power and approximately 225 RPM engine speed to approximately 24 dB TDC corresponding to approximately 50 kW engine power and approximately 1980 RPM engine speed.

9. The method of claim 1, further comprising:

selecting a base fuel pressure in a common rail system that corresponds to an engine speed and an engine power from a plurality of base fuel pressures in a pre-calibrated first table, the pre-calibrated first table comprising only the plurality of base fuel pressures as a function of only the engine speed and the engine power; and responding to the obtained one or more ambient environmental conditions being outside of the defined threshold operating range of environmental conditions by one or more of:

increasing to a first fuel pressure relative to the base fuel pressure proportionally with an increase in the engine power for each engine speed listed on the pre-calibrated first table that is below a first determined engine speed threshold; and decreasing to a second fuel pressure relative to the base fuel pressure proportionally with a decrease in the engine power for each engine speed listed on the pre-calibrated first table that is below a second determined engine speed threshold.

10. The method of claim 9, further comprising increasing the base fuel pressure from 600 bar corresponding to approximately 50 kW engine power and approximately 225 RPM engine speed to approximately 1525 bar corresponding to approximately 1100 kW engine power and approximately 1980 RPM engine speed.

11. The method of claim 1, further comprising:

selecting a base fuel pressure supplied to a cylinder in the engine that corresponds to an engine speed and an engine power from a plurality of base fuel pressures in a pre-calibrated first table, the pre-calibrated first table comprising only the plurality of base fuel pressures as a function of only the engine speed and the engine power; and responding to the obtained one or more ambient environmental conditions being outside of the defined threshold operating range of environmental conditions by one or more of:

increasing to a first fuel pressure relative to the base fuel pressure proportionally with an increase in the engine power for each engine speed listed on the pre-calibrated first table that is below a first determined engine speed threshold; and decreasing to a second fuel pressure relative to the base fuel pressure proportionally with a decrease in the engine power for each engine speed listed on the pre-calibrated first table that is below a second determined engine speed threshold.

12. A system, comprising:

an engine comprising a plurality of cylinders organized into two cylinder banks;

one or more sensors; and a controller storing instructions in memory of the controller, the instructions executable to:

obtain one or more ambient environmental conditions from the one or more sensors;

obtain a desired throttle level for the engine;

obtain a first set of determined engine operating parameters, including an engine speed and an engine load, and a second set of determined engine operating parameters, including a base timing and a fuel common rail pressure, based at least in part on the desired throttle level and an engine operating map;

change the first set of determined engine operating parameters obtained from the engine operating map based at least in part on the obtained one or more ambient environmental conditions being outside of a defined threshold operating range of environmental conditions; and change the second set of determined engine operating parameters obtained from the engine operating map based on the changed first set of determined engine operating parameters.

13. The system of claim 12, wherein the first set of determined engine operating parameters comprises only an engine speed and an engine load.

14. The system of claim 12, wherein changing the first set of determined engine operating parameters obtained from the engine operating map based at least in part on the obtained one or more ambient environmental conditions being outside of the defined threshold operating range of environmental conditions comprises:

determining if the obtained one or more ambient environmental conditions is a temperature measured to be greater than a determined threshold temperature; and reducing an engine speed responsive to the obtained one or more ambient environmental conditions being the temperature measured to be greater than the determined threshold temperature.

15. The system of claim 14, wherein the determined threshold temperature is about 50 degrees Celsius.

16. The system of claim 12, wherein the controller is further configured to increase a base timing from approximately 5 dB TDC at an idle throttle level to approximately 17 dB TDC at a first throttle level that is higher than the idle throttle level.

17. The system of claim 16, wherein the controller is further configured to decrease the base timing from approximately 17 dB TDC at the first throttle level that is higher than the idle throttle level to approximately 11 dB TDC at a second throttle level that is higher than the first throttle level and lower than a maximum throttle level, wherein the first throttle level is lower than the second throttle level.

18. The system of claim 17, wherein the controller is further configured to increase the base timing from approximately 11 dB TDC at the second throttle level to about 22 dB TDC at the maximum throttle level.

19. The system of claim 12, wherein the controller is further configured to select a base timing corresponding to an engine speed and an engine power from a plurality of base timings in a pre-calibrated first table, the pre-calibrated first table comprising only the plurality of base timings as a function of only the engine speed and the engine power, and respond to the obtained one or more ambient environmental conditions being outside of the defined threshold operating range of environmental conditions by one or more of:

increasing to a first timing relative to the base timing proportionally with an increase in the engine power for each engine speed listed on the pre-calibrated first table that is below a first determined engine speed threshold; and decreasing to a second timing relative to the base timing proportionally with a decrease in the engine power for each engine speed listed on the pre-calibrated first table that is below a second determined engine speed threshold.

20. The system of claim 12, wherein the two cylinder banks comprise a first bank of cylinders and a second bank of cylinders, wherein the first set of determined engine operating parameters comprise an amount and a pressure of intake air of the first bank of cylinders relative to the second bank of cylinders, and wherein the controller is further configured to modify a first operating mode of the first bank of cylinders differently and independently from a second operating mode of the second bank of cylinders.

* * * * *